US012084863B1

(12) United States Patent
Harris

(10) Patent No.: US 12,084,863 B1
(45) Date of Patent: Sep. 10, 2024

(54) COUPLER FOR CONCRETE REINFORCING MEMBERS

(71) Applicant: T. J. Harris Company, Knoxville, TN (US)

(72) Inventor: Terry L. Harris, Mascot, TN (US)

(73) Assignee: T. J. Harris Company, Knoxville, TN (US)

( * ) Notice: Subject to any disclaimer, the term of this patent is extended or adjusted under 35 U.S.C. 154(b) by 0 days.

(21) Appl. No.: 18/641,477

(22) Filed: Apr. 22, 2024

Related U.S. Application Data

(63) Continuation-in-part of application No. 29/936,461, filed on Apr. 9, 2024.

(51) Int. Cl.
*E04C 5/16* (2006.01)
*E04B 1/58* (2006.01)

(52) U.S. Cl.
CPC ..... *E04C 5/163* (2013.01); *E04C 5/165* (2013.01); *E04B 2001/5887* (2013.01)

(58) Field of Classification Search
CPC ... E04C 5/163; E04C 5/165; E04B 2001/5887
See application file for complete search history.

(56) References Cited

U.S. PATENT DOCUMENTS 3,079,186 A * 2/1963 Williams ..... F16B 7/0433 403/362
4,080,084 A * 3/1978 Williams ..... E04C 5/163 403/399
4,362,423 A 12/1982 Miles
4,617,775 A * 10/1986 Padrun ..... E04C 5/163 403/397

(Continued)

FOREIGN PATENT DOCUMENTS

CA 2589974 A1 * 12/2008 ..... E04C 5/163
CN 110318498 A * 10/2019 ..... E04C 5/165

(Continued)

OTHER PUBLICATIONS

Electronic document titled "Mechanical Rebar Splicing Systems" published by nVent Services GmbH as early as Nov. 7, 2023 and retrieved from the Internet: https://www.nvent.com/sites/default/files/acquiadam/assets/RSB-WWEN.pdf.

(Continued)

*Primary Examiner* — Jessie T Fonseca
(74) *Attorney, Agent, or Firm* — Luedeka Neely, P.C.

(57) ABSTRACT

A single-piece construction coupler for securing reinforcing bars in a parallel relationship includes a sleeve having a center portion, a first end portion extending from one end of the center portion, a second end portion extending from the opposing end of the center portion, and a channel. The center portion includes opposing sidewalls connected by an upper wall, and each of the end portions comprise opposing sidewalls connected by lower walls. Securing tabs extend into the channel from the bottom of the upper wall. Ridges extend into the channel from each of the lower walls and the upper wall. The center portion and the end portions each include fillets connecting the sidewalls and the ridges to upper and lower walls to form rounded surfaces for receiving the reinforcing bars. The sleeve also includes grip protrusions on its outer surfaces.

16 Claims, 4 Drawing Sheets

(56) References Cited

U.S. PATENT DOCUMENTS

| | | | | |
|---|---|---|---|---|
| 4,968,176 | A * | 11/1990 | Balach | F16B 7/0433 403/396 |
| 5,794,897 | A | 8/1998 | Jobin et al. | |
| 6,435,565 | B2 | 8/2002 | Potts et al. | |
| 10,301,825 | B1 * | 5/2019 | Uncapher | E04C 5/166 |
| 10,597,873 | B2 | 3/2020 | Uncapher | |
| 2004/0099785 | A1 * | 5/2004 | Juedes | E04C 5/163 249/34 |
| 2006/0053735 | A1 | 3/2006 | Kim | |
| 2008/0209843 | A1 * | 9/2008 | Helms | E04C 5/163 52/742.14 |
| 2008/0271409 | A1 * | 11/2008 | Kodi | E04C 5/167 52/745.21 |
| 2010/0024344 | A1 | 2/2010 | Murayama et al. | |
| 2011/0107714 | A1 * | 5/2011 | Kodi | E04C 5/20 52/686 |
| 2012/0055113 | A1 * | 3/2012 | Cech | E04C 5/163 52/686 |
| 2013/0028658 | A1 * | 1/2013 | Yee | E04B 1/41 29/527.1 |
| 2014/0308474 | A1 * | 10/2014 | Subacchi | E04C 5/168 428/81 |
| 2015/0000227 | A1 * | 1/2015 | Yee | F16B 7/0433 403/188 |
| 2015/0322676 | A1 * | 11/2015 | Yee | E04B 1/41 52/704 |

FOREIGN PATENT DOCUMENTS

| | | | | |
|---|---|---|---|---|
| CN | 113137009 | A * | 7/2021 | E04C 5/162 |
| DE | 4335267 | A1 * | 4/1995 | E04C 5/163 |
| KR | 20080075239 | A * | 8/2008 | |
| KR | 100984243 | B1 * | 10/2010 | |
| KR | 20190118377 | A * | 10/2019 | |
| KR | 102203621 | B1 * | 1/2021 | |
| WO | WO-2006031407 | A2 * | 3/2006 | B25H 3/04 |
| WO | WO-2008018161 | A1 * | 2/2008 | E04C 5/165 |
| WO | WO-2008023456 | A1 * | 2/2008 | E04C 5/163 |
| WO | 2011159049 | A2 | 12/2011 | |
| WO | WO-2013074123 | A2 * | 5/2013 | E04C 5/163 |

OTHER PUBLICATIONS

Webpage describing "Fastcoup rebar couplers" published by Regbar Construction Technology Solutions as early as Nov. 7, 2023 and retrieved from the Internet: https://regbar.com/products/rebar-couplers/fastcoup/.

Webpage describing "Nicopress Copper Sleeve" published by Univair Aircraft Corp. as early as Nov. 7, 2023 and retrieved from the Internet: https://www.univair.com/hardware/view-all/18-3-m-nicopress-copper-sleeve-1-8-inch/.

* cited by examiner

COUPLER FOR CONCRETE REINFORCING MEMBERS

FIELD

This disclosure generally relates to the field of reinforcing bar couplers used in construction of concrete structures. More particularly, this disclosure is directed to an improved, single-piece construction coupler for securing reinforcing bars in parallel to one another.

BACKGROUND

Reinforcement bars made of steel, glass fiber reinforced polymer, and other materials are typically used in concrete slabs and other concrete structures to provide structural support to the concrete. Yet it is often impossible to reinforce tall and long concrete structures with continuous, solid lengths of reinforcing bars because of manufacturing, transportation, and installation issues involved with very long reinforcing bars. Accordingly, users often "splice" or couple together multiple shorter lengths of reinforcing bars to meet the requisite length for proper reinforcement using a variety of coupling structures.

Prior structures for joining reinforcing bars together, also referred to as "splicers" or couplers, are lacking in several respects. In particular, prior coupler designs often involve manipulation of the coupler or the reinforcing bars within the coupler, which may be difficult and unwieldy due to the weight of the reinforcing bars and the location of the splice (e.g., high up). Other coupler designs involve the use of intervening structures such as pins and other fasteners to wedge between the reinforcing bars within the couplers, which requires both careful manipulation of the reinforcing bars and, in some cases, specialized tools. Moreover, the manufacture of these prior structures involves additional manufacturing steps, which increase the overall cost of the coupler.

Accordingly, what is desired is a strong, easy-to-use, and low-cost structure for splicing together reinforcement bars in concrete slabs.

SUMMARY

The above and other needs are met by a single-piece construction coupler for coupling a pair of parallel reinforcing bars in a concrete structure.

In one embodiment, the apparatus comprises a sleeve that defines a channel in which a pair parallel reinforcing bars are received. The sleeve includes a center portion disposed between a first end portion and a second end portion. The center portion includes a pair of opposing center sidewalls disposed on opposing sides of the channel. Each center sidewall has an upper edge, a lower edge, an inner surface, and an outer surface. The center portion also includes an upper wall connected to the upper edges of the opposing center sidewalls and disposed above the channel. The upper wall has an upper surface, a lower surface, and a first ridge extending downwardly from the lower surface of the upper wall into the channel.

The first end portion includes a pair of opposing first end sidewalls that extend from the opposing center sidewalls and disposed on opposing sides of the channel. Each of the first end sidewalls have an upper edge, a lower edge, an inner surface, and an outer surface. The first end portion also includes a first lower wall connected to the lower edges of the first end sidewalls and disposed below the channel. The first lower wall has an upper surface, a lower surface, and a second ridge extending upwardly into the channel from the upper surface of the first lower wall.

The second end portion includes a pair of opposing second end sidewalls that extend from the opposing center sidewalls and disposed on opposing sides of the channel. Each of the second end sidewalls have an upper edge, a lower edge, an inner surface, and an outer surface. The second end portion also includes a second lower wall connected to the lower edges of the second end sidewalls and disposed below the channel. The second lower wall has an upper surface, a lower surface, and a third ridge extending upwardly into the channel from the upper surface of the second lower wall.

In some embodiments, the outer surfaces of the center sidewalls, the outer surfaces of the first end sidewalls, and the outer surfaces of the second end sidewalls are tilted with respect to the first and second lower walls at an angle that ranges from about 4 degrees to about 6 degrees.

In some embodiments, the sleeve includes grip protrusions that extend outwardly from the outer surfaces of the center sidewalls.

In some embodiments, the sleeve also includes grip protrusions that extend outwardly from the outer surfaces of the first and second end sidewalls.

In some embodiments, the sleeve includes fillets that connect various structures. In one embodiment, the sleeve includes first upper fillets that connect the first ridge to the lower surface of the upper wall, and second upper fillets that connect the inner surfaces of the opposing center sidewalls to the lower surface of the upper wall. The first upper fillets, second upper fillets, inner surfaces of the center sidewalls, and lower surface of the upper wall define rounded surfaces that are dimensioned and configured to securely receive the pair of parallel reinforcing bars having a round outer profile.

In some embodiments, the sleeve includes first, second, third and fourth lower fillets. The first lower fillets connect the second ridge to the upper surface of the first lower wall. The second lower fillets connect the inner surfaces of the first end sidewalls to the upper surface of the first lower wall. The third lower fillets connect the third ridge to the upper surface of the second lower wall. The fourth lower fillets connect the inner surfaces of the second end sidewalls to the upper surface of the second lower wall. The first, second, third, and fourth lower fillets, and the inner surfaces of the first and second end sidewalls, and the upper surfaces of the first and second lower walls define rounded surfaces that are dimensioned and configured to securely receive the pair of parallel reinforcing bars having a round outer profile.

In some embodiments, the center portion, first end portion, and second end portion of the sleeve comprise a unitary structural element. In some embodiments, the center portion, first end portion, and second end portion of the sleeve are formed from a continuous piece of thermoplastic material.

In some embodiments, the center portion of the sleeve includes a plurality of securing tabs that extend downwardly from the lower surface of the upper wall into the channel.

In another aspect, embodiments described herein are directed to a method for using the single-piece construction coupler described above to couple a first reinforcing bar parallel to a second reinforcing bar. The method includes inserting the first reinforcing bar through the channel so that it first contacts the sleeve in the first end portion, then in the center portion, and finally in the second end portion, and is secured in place by one of the securing tabs. The method also includes inserting the second reinforcing bar through the channel so that it first contacts the sleeve in the second end portion, then in the center portion, and finally in the first end portion, and is secured in place by another of the plurality of securing tabs.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 5A:
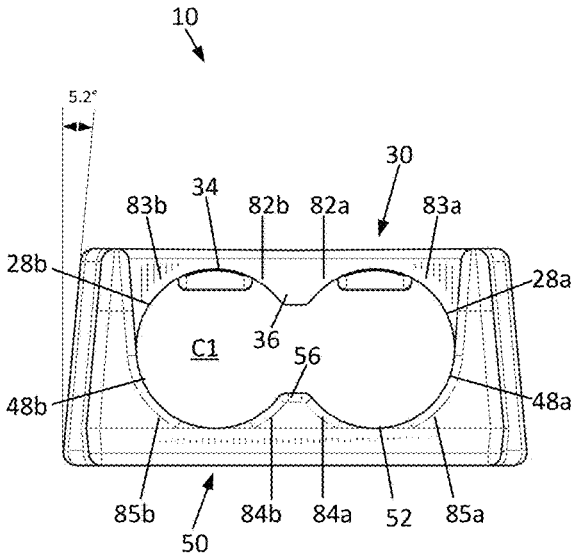
FIG. 5A provides an elevation view of a first end portion the coupler of FIG. 1.
Figure 5B:
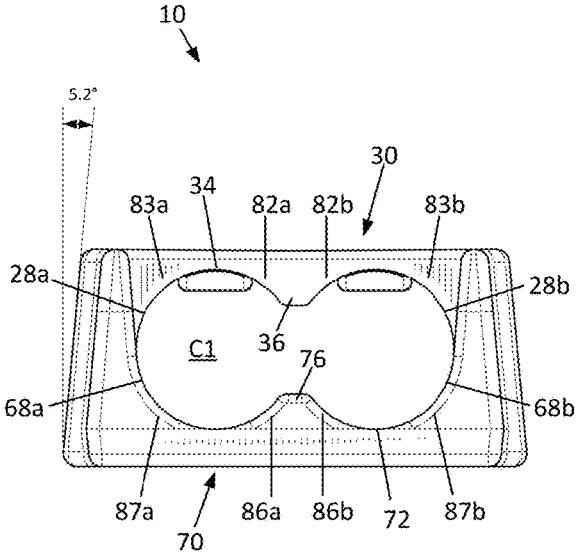
FIG. 5B provides an elevation view of a second end portion the coupler of FIG. 1.
Figure 6:
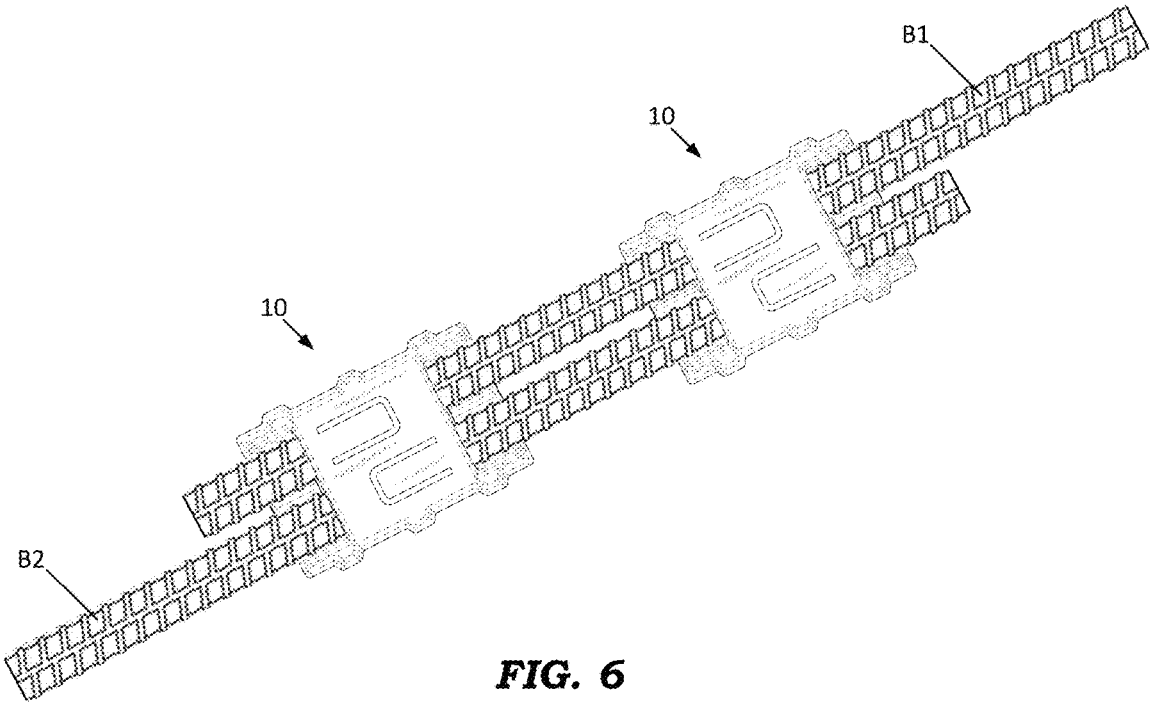
FIG. 6 depicts two concrete reinforcement bars coupled together by two of the couplers of FIG. 1.

Depicted in FIGS. 1-6 is a structure 10, also referred to herein as a sleeve or coupler, for splicing together two concrete reinforcement bars. As shown in FIG. 6, two or more of the sleeves 10 may be used to hold together concrete reinforcement bars B1 and B2 in a substantially parallel relationship as concrete is poured around the sleeve 10 and the bars B1 and B2 to form a concrete structure. As one skilled in the art will appreciate, many such sleeves 10 may be used to create an extended length of reinforcement bars to support long concrete slabs.

Figure 1:
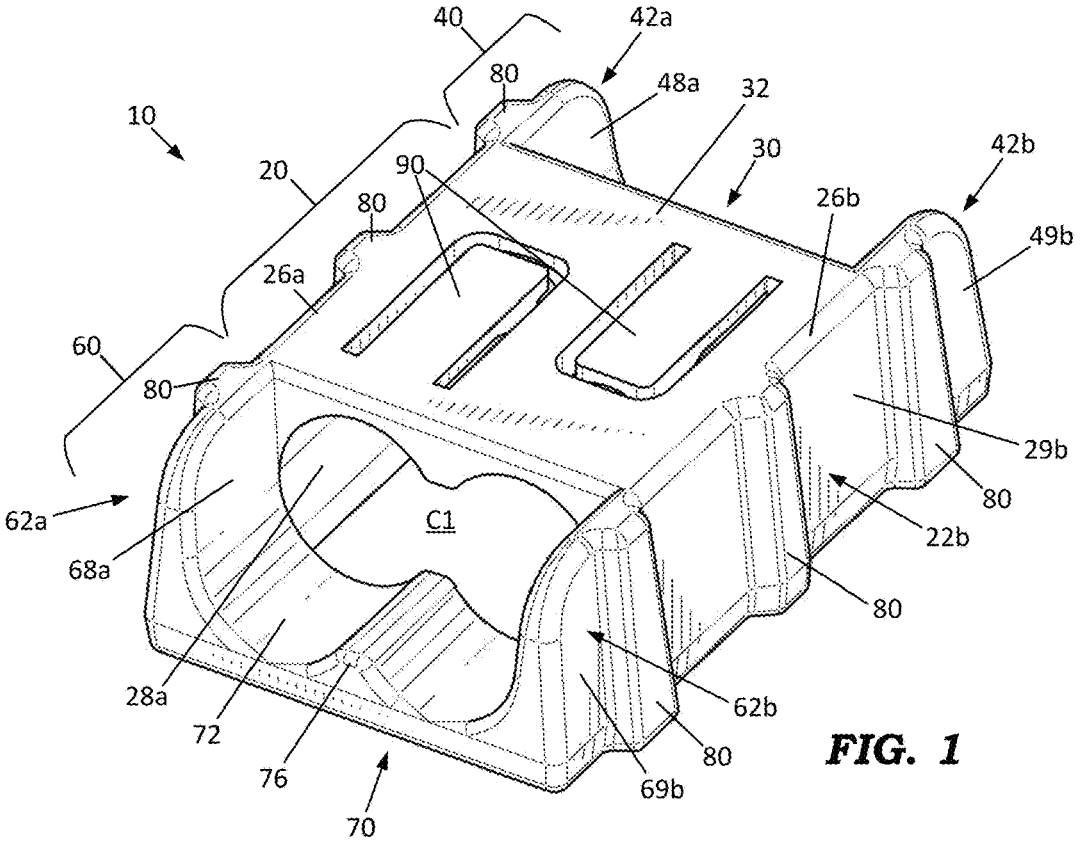
FIG. 1 provides a top perspective view of a coupler for concrete reinforcing bars in accordance with a first embodiment.
Figure 2:
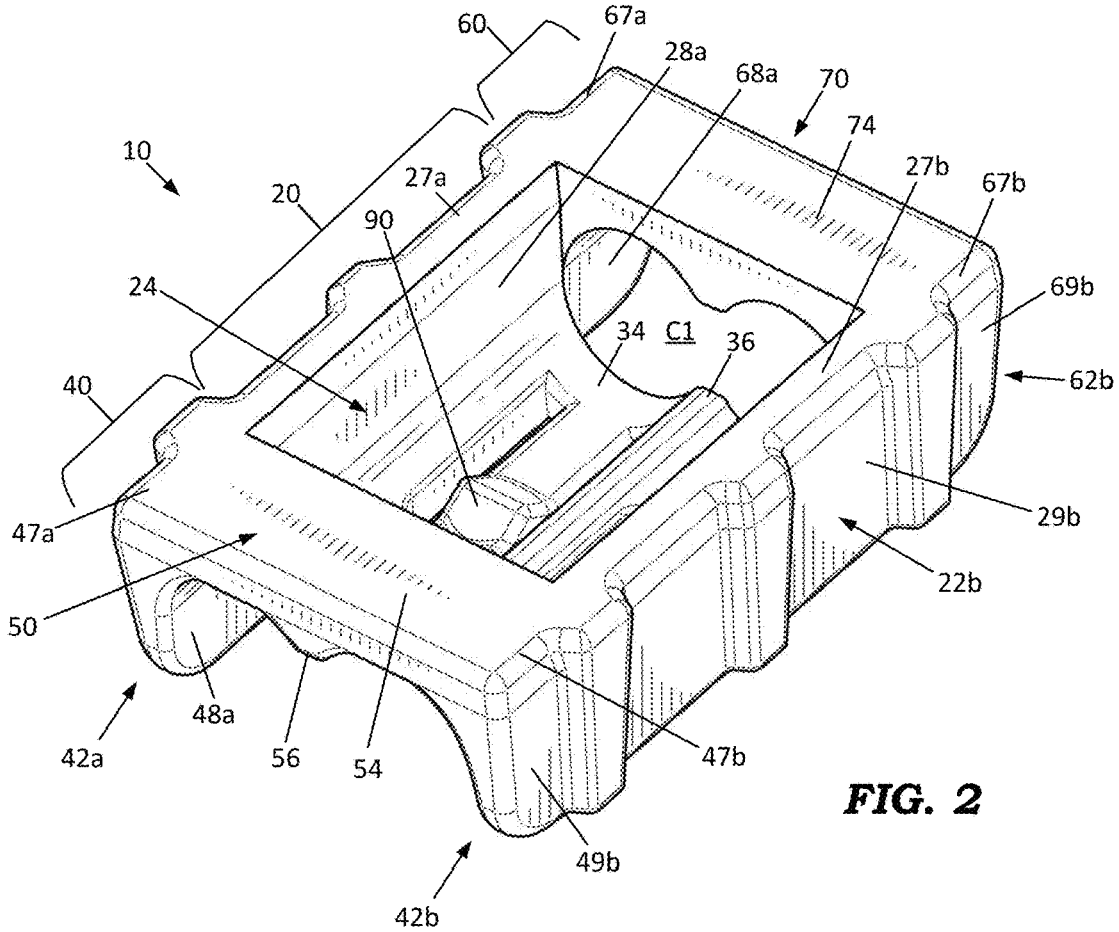
FIG. 2 provides a bottom perspective view of the coupler of FIG. 1.
Figure 3A:
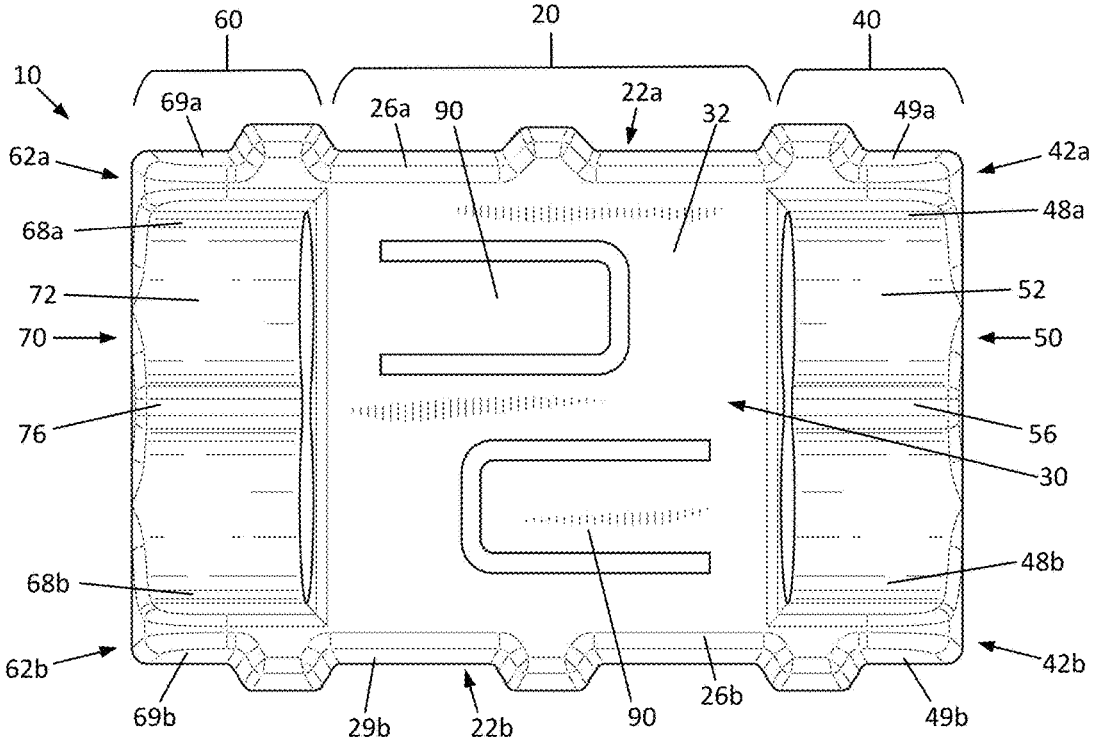
FIGS. 3A and 3B provide top plan views of the coupler of FIG. 1.
Figure 3B:
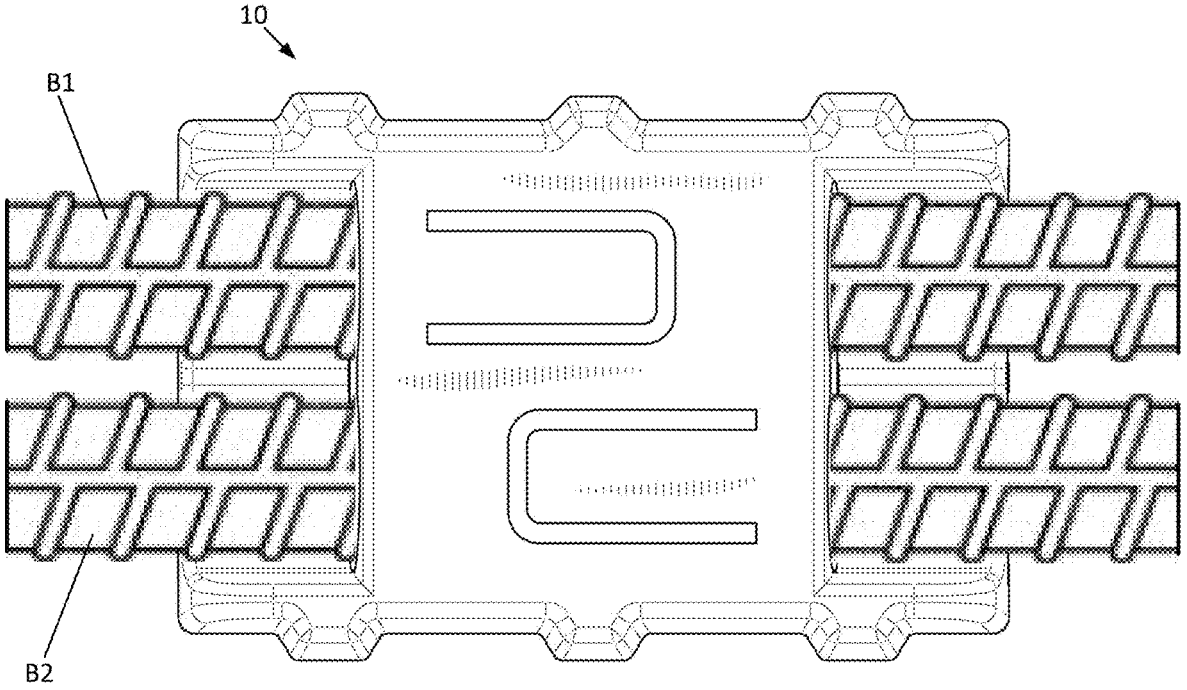

As shown in FIGS. 1 and 2, the sleeve 10 defines a channel C1 through which bars B1 and B2 are received. In use, the bars B1 and B2 are configured to contact various surfaces of the sleeve 10 as they are inserted into the channel C1. In a preferred embodiment, the bars B1 and B2 each contact the sleeve 10 in three locations: a center portion 20, a first end portion 40, and a second end portion 60. Though the sleeve 10 described herein has a generally trapezoidal cross section and rectangular perimeter, it should be noted that the cross section and perimeter of the sleeve 10 could be rounded, squared, or any other desired shape.

As described in further detail hereinafter, the sleeve 10 includes various walls and surfaces that are dimensioned and configured to securely receive reinforcing bars that have a round outer profile. It is noted, however, that the sleeve 10 could be modified to receive reinforcing bars having other profiles, such as a rectangular profile. In a preferred embodiment of the sleeve 10, the center portion 20 includes a pair of opposing center sidewalls 22*a* and 22*b* disposed on opposing sides of the channel C1. The center sidewalls 22*a*-22*b* have upper edges 26*a* and 26*b*, lower edges 27*a* and 27*b*, inner surfaces 28*a* and 28*b*, and outer surfaces 29*a* and 29*b*. An upper wall 30 is connected to the upper edges 26*a*-26*b* of the center sidewalls 22*a*-22*b*. In some embodiments, the upper wall 30 may be connected to the upper edges 26*a*-26*b* along the entire length of the center sidewalls 22*a*-22*b*. In other embodiments, the upper wall 30 may be connected to the upper edges 26*a*-26*b* along only a portion of the length of the center sidewalls 22*a*-22*b*. The upper wall 30 has an upper surface 32 and an opposing lower surface 34. A central portion of the lower surface 34 of the upper wall 30 forms a first ridge 36 that extends downwardly into the channel C1.

In some embodiments, securing tabs 90 are provided in the center portion 20 as cantilevered sections of the upper wall 30, with ridge-like protrusions that extend downwardly into the channel C1 to secure the reinforcing bars therein. The protrusions could take any number of other suitable forms, such as semispherical or any other suitable shape for engaging the reinforcement bars. The cantilevered configuration, along with numerous other possible securing tab shapes and configurations, can be used to fine-tune the ease of insertion and removal of reinforcing bars. In addition to the three contact surfaces mentioned above, the securing tabs 90 provide an interference fit that further prevents the reinforcing bars from sliding out of the sleeve 10.

In a preferred embodiment, the first end portion 40 and the second end portion 60 of the sleeve 10 are disposed on either end of the center portion 20. The first end portion 40 includes a pair of opposing first end sidewalls 42*a*-42*b*, wherein the first end sidewall 42*a* extends outwardly from the center sidewall 22*a*, and the first end sidewall 42*b* extends outwardly from the center sidewall 22*b*. The first end sidewalls 42*a*-42*b* have lower edges 47*a*-47*b*, inner surface 48*a*-48*b*, and outer surfaces 49*a*-49*b*, respectively. Connected to the lower edges 47*a*-47*b* of the first end sidewalls 42*a*-42*b* is a first lower wall 50. In some embodiments, the first lower wall 50 may be connected to the lower edges 47*a*-47*b* along the entire length of the first end sidewalls 42*a*-42*b*. In other embodiments, the first lower wall 50 may be connected to the lower edges 47*a*-47*b* along only a portion of the length of the first end sidewalls 42*a*-42*b*. The first lower wall 50 has an upper surface 52 and an opposing lower surface 54. In the preferred embodiment, the first lower wall 50 includes a second ridge 56 that extends upwardly from the upper surface 52 and into the channel C1.

Similarly, the second end portion 60 includes a pair of opposing second end sidewalls 62*a*-62*b*, wherein the second end sidewall 62*a* extends outwardly from the center sidewall 22*a* and second end sidewall 62*b* extends outwardly from the center sidewall 22*b*. The second end sidewalls 62*a*-62*b* have lower edges 67*a*-67*b*, inner surfaces 68*a*-68*b*, and outer surfaces 69*a*-69*b*, respectively. Connected to the lower edges 67*a*-67*b* of the second end sidewalls 62*a*-62*b* is a second lower wall 70. In some embodiments, the second lower wall 70 may be connected to the lower edges 67*a*-67*b* along the entire length of the second end sidewalls 62*a*-62*b*. In other embodiments, the second lower wall 70 may be connected to the lower edges 67*a*-67*b* along only a portion of the length of the second end sidewalls 42*a*-42*b*. The second lower wall 70 has an upper surface 72 and an opposing lower surface 74. In the preferred embodiment, the second lower wall 70 further includes a third ridge 76 that extends upwardly from the upper surface 72 and into the channel C1.

Figure 4A:
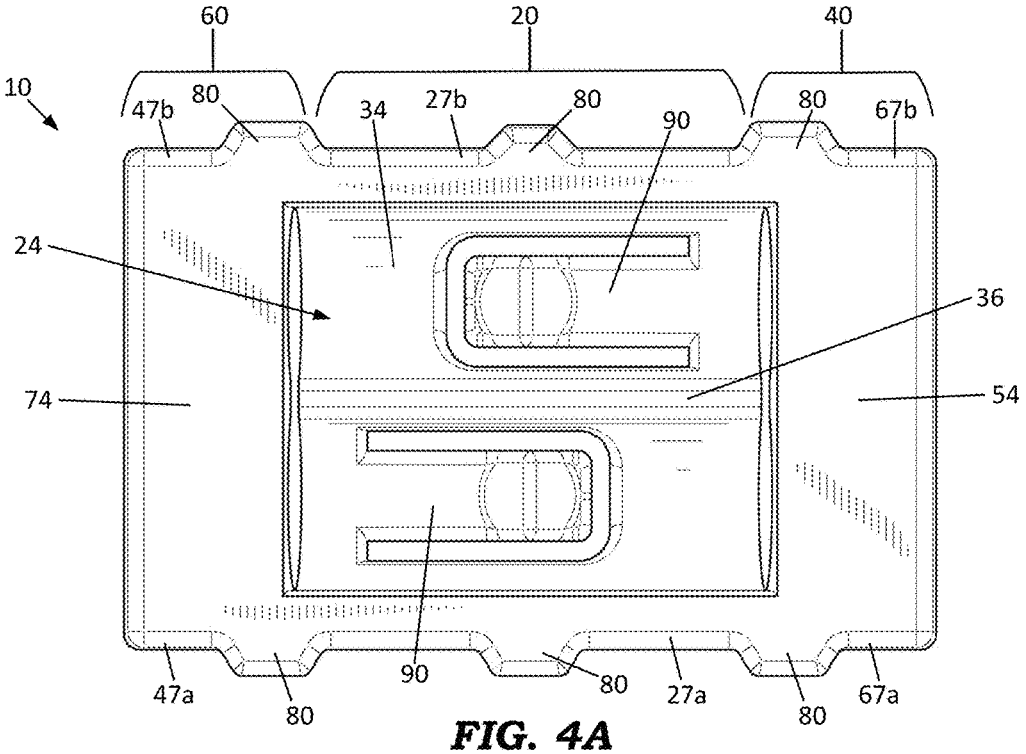
FIGS. 4A and 4B provide bottom plan views of the coupler of FIG. 1.
Figure 4B:
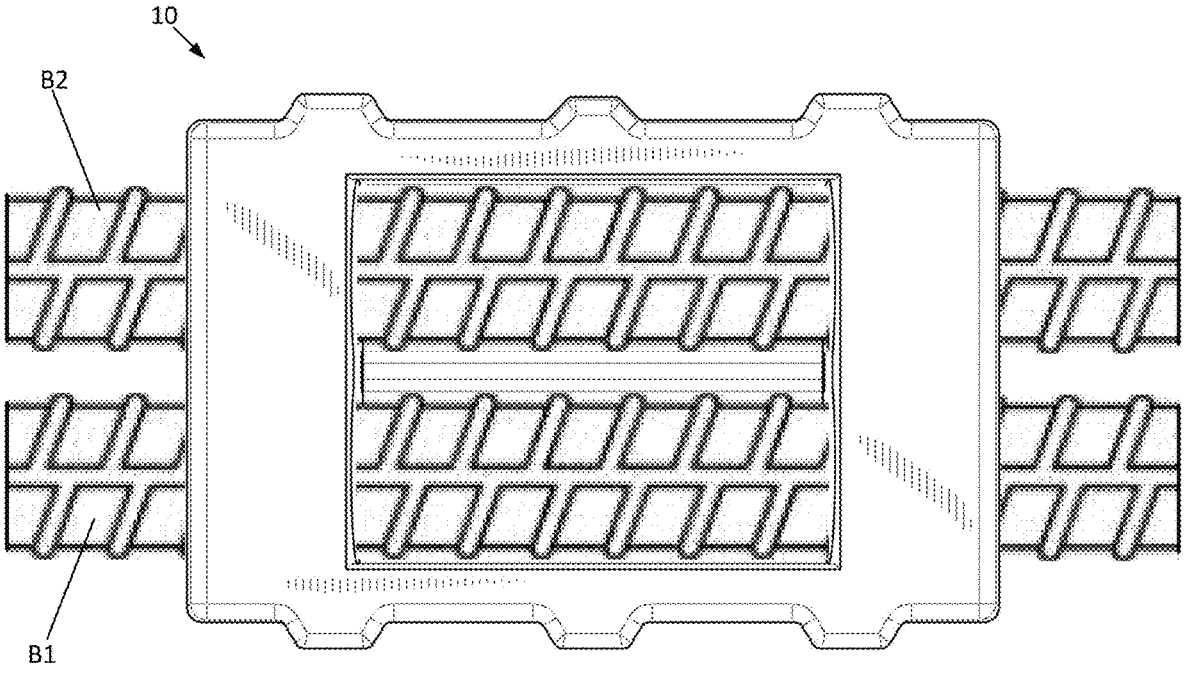

As shown in FIGS. 2 and 4A, a preferred embodiment of the sleeve 10 includes a generally rectangular opening 24 between the lower edges 27*a*-27*b* of the center sidewalls 22*a*-22*b*, and between the first lower wall 50 and the second lower wall 70. The presence of the opening 24 reduces the amount of material required for fabrication of the sleeve 10, as well as its overall weight.

In some preferred embodiments, the center sidewalls 22*a*-22*b*, first end sidewalls 42*a*-42*b*, and second end sidewalls 62*a*-62*b* are substantially coplanar, such that the outer surfaces 29*a*, 49*a*, and 69*a* and the outer surfaces 29*b*, 49*b*, and 69*b* form continuous outer walls for the sleeve 10. In some embodiments, the outer surfaces 29*a*-29*b*, 49*a*-49*b*, and 69*a*-69*b* are tilted inwardly at an angle with respect to the first and second lower walls 50 and 70. In the embodiment depicted in FIGS. 5A and 5B, the tilt angle is about 5 degrees, but could range from about 4 degrees to about 6 degrees in other embodiments.

In some preferred embodiments, grip protrusions 80 extend outwardly from the outer surfaces of the various sidewalls of the sleeve 10. The grip protrusions 80 are configured to case the installation of reinforcing bars into the sleeve 10 by creating fingerholds for the user. The grip protrusions 80 prevent slippage due to wet conditions and provide tactile feedback when it is difficult for the user to see or feel the sleeve 10, such as when wearing thick constructions gloves. In a preferred embodiment, the grip protrusions 80 are regularly and symmetrically distributed along the various outer surfaces of the sidewalls of the sleeve 10, and have a rounded shape with a semicylindrical cross section. However, the grip protrusions may take any number of other forms, and may be irregularly or asymmetrically distributed.

Preferably, the center portion 20 and the first and second end portions 40 and 60 also include various upper fillets and lower fillets that connect and reinforce various portions of the sleeve 10 to provide additional strength and stability when reinforcing bars are disposed therein. As shown in FIGS. 5A and 5B, a pair of first upper fillets 82*a*-82*b* connect the first ridge 36 to the lower surface 34 of the upper wall 30, and a pair of second upper fillets 83*a*-83*b* connect the inner surfaces 28*a*-28*b* to the lower surface 34 of the upper wall 30. The first upper fillets 82*a*-82*b*, the second upper fillets 83*a*-83*b*, the inner surfaces 28*a*-28*b*, and the lower surface 34 of the upper wall 30 define rounded surfaces for receiving parallel reinforcing bars that have rounded outer profiles.

In preferred embodiments, the first and second end portions 40 and 60 also include various lower fillets. As shown in FIGS. 5A and 5B, the first end portion 40 includes first lower fillets 84*a*-84*b* that connect the second ridge 56 to the upper surface 52 of the first lower wall 50, and second lower fillets 85*a*-85*b* that connect the inner surfaces 48*a*-48*b* to the upper surface 52 of the first lower wall 50. The first lower fillets 84*a*-84*b*, the second lower fillets 85*a*-85*b*, the inner surfaces 48*a*-48*b*, and the upper surface 52 of the first lower wall 50 define rounded surfaces for receiving parallel reinforcing bars having rounded outer profiles. Similarly, the second end portion 60 includes third lower fillets 86*a*-86*b* that connect the third ridge 76 to the upper surface 72 of the second lower wall 70, and fourth lower fillets 87*a*-87*b* that connect the inner surfaces 68*a*-68*b* to the upper surface 72 of the second lower wall 70. The third lower fillets 86*a*-86*b*, the fourth lower fillets 87*a*-87*b*, the inner surfaces 68*a*-68*b*, and the upper surface 72 of the second lower wall 70 define rounded surfaces for receiving parallel reinforcing bars having a rounded outer profile.

In the preferred embodiment of the invention, all of the components of the sleeve 10 are formed from one continuous piece of thermoplastic, such as polypropylene. Such a material is rigid enough to support the weight of the reinforcement bars, while being flexible enough to allow the sidewalls 22*a*-22*b*, 42*a*-42*b*, and 62*a*-62*bb*, and securing tabs 90 to flex slightly to receive the reinforcement bars as described above. Thus, when a reinforcement bar is inserted within the channel C1, the sleeve 10 may flex somewhat to allow the reinforcement bar to slide past the securing tab 90 but still provide sufficient contact interference to secure the reinforcing bar within the channel, so it cannot be easily or inadvertently removed.

As one skilled in the art will appreciate, the sleeve 10 as described herein can be formed using an injection molding process in a two-piece injection mold. For ease of ejection from such a mold, the outer surfaces 29*a*-29*b*, 49*a*-49*b*, and 69*a*-69*b* of a preferred embodiment of the sleeve 10 are configured to lean slightly inward.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. An apparatus for coupling a pair of parallel reinforcing bars in a concrete structure, the apparatus comprising a sleeve that defines a channel in which the pair of parallel reinforcing bars are received, the sleeve comprising:

a center portion disposed between first and second end portions, the center portion comprising:

a pair of opposing center sidewalls disposed on opposing sides of the channel, each center sidewall having an upper edge, a lower edge, an inner surface, and an outer surface; and an upper wall connected to the upper edges of the opposing center sidewalls and disposed above the channel, the upper wall having an upper surface, a lower surface, and a first ridge extending downwardly from the lower surface of the upper wall into the channel;

the first end portion comprising:

a pair of opposing first end sidewalls extending from the opposing center sidewalls of the center portion and disposed on the opposing sides of the channel, each first end sidewall having an upper edge, a lower edge, an inner surface, and an outer surface; and a first lower wall connected to the lower edges of the opposing first end sidewalls and disposed below the channel, the first lower wall having an upper surface, a lower surface, and a second ridge extending upwardly from the upper surface of the first lower wall into the channel; and the second end portion comprising:

a pair of opposing second end sidewalls extending from the opposing center sidewalls of the center portion and disposed on the opposing sides of the channel, each second end sidewall having an upper edge, a lower edge, an inner surface, and an outer surface; and a second lower wall connected to the lower edges of the opposing second end sidewalls and disposed below the channel, the second lower wall having an upper surface, a lower surface, and a third ridge extending upwardly from the upper surface of the second lower wall into the channel.

2. The apparatus of claim 1 wherein the outer surfaces of the opposing center sidewalls, the outer surfaces of the first end sidewalls, and the outer surfaces of the second end sidewalls are tilted an angle that ranges from about 4 degrees to about 6 degrees with respect to the first and second lower walls.

3. The apparatus of claim 1 further comprising grip protrusions that extend outwardly from the outer surfaces of the center sidewalls.

4. The apparatus of claim 1 further comprising grip protrusions that extend outwardly from the outer surfaces of the first and second end sidewalls.

5. The apparatus of claim 1 further comprising:

first upper fillets that connect the first ridge to the lower surface of the upper wall; and second upper fillets that connect the inner surfaces of the opposing center sidewalls to the lower surface of the upper wall, wherein the first upper fillets, the second upper fillets, the inner surfaces of the center sidewalls, and the lower surface of the upper wall define rounded surfaces that are dimensioned and configured for securely receiving the pair of parallel reinforcing bars having a round outer profile.

6. The apparatus of claim 1 further comprising:

first lower fillets that connect the second ridge to the upper surface of the first lower wall;

second lower fillets that connect the inner surfaces of the first end sidewalls to the upper surface of the first lower wall;

third lower fillets that connect the third ridge to the upper surface of the second lower wall; and fourth lower fillets that connect the inner surfaces of the second end sidewalls to the upper surface of the second lower wall, wherein the first lower fillets, the second lower fillets, the third lower fillets, the fourth lower fillets, the inner surfaces of the first and second end sidewalls, and the upper surfaces of the first and second lower walls define rounded surfaces that are dimensioned and configured for securely receiving the pair of parallel reinforcing bars having a round outer profile.

7. The apparatus of claim 1 wherein the center portion, the first end portion, and the second end portion comprise a unitary structural element.

8. The apparatus of claim 7 wherein the center portion, the first end portion, and the second end portion are formed from a continuous piece of thermoplastic material.

9. The apparatus of claim 1, wherein the center portion further comprises a plurality of securing tabs disposed on the lower surface of the upper wall that extend downwardly from the lower surface of the upper wall into the channel.

10. A method for using the apparatus of claim 9 to couple a first reinforcing bar in parallel to a second reinforcing bar, the method comprising:

inserting the first reinforcing bar through the channel such that the first reinforcing bar first contacts the sleeve in the first end portion, then in the center portion, and finally in the second end portion, wherein the first reinforcing bar is secured in place by at least a first one of the plurality of securing tabs; and inserting the second reinforcing bar through the channel such that the second reinforcing bar first contacts the sleeve in the second end portion, then in the center portion, and finally in the first end portion wherein the second reinforcing bar is secured in place by at least a second one of the plurality of securing tabs.

11. An apparatus for coupling a pair of parallel reinforcing bars in a concrete structure, the apparatus comprising a sleeve that defines a channel in which the pair of parallel reinforcing bars are received, the sleeve comprising:

a center portion disposed between first and second end portions, the center portion comprising:

a pair of opposing center sidewalls disposed on opposing sides of the channel, each center sidewall having an upper edge, a lower edge, an inner surface, and an outer surface;

grip protrusions that extend outwardly from the outer surfaces of the center sidewalls;

an upper wall connected to the upper edges of the opposing center sidewalls and disposed above the channel, the upper wall having an upper surface, a lower surface, and a first ridge extending downwardly from the lower surface of the upper wall into the channel; and a plurality of securing tabs disposed on the lower surface of the upper wall that extend downwardly from the lower surface of the upper wall into the channel;

the first end portion comprising:

a pair of opposing first end sidewalls extending from the opposing center sidewalls of the center portion and disposed on the opposing sides of the channel, each first end sidewall having an upper edge, a lower edge, an inner surface, and an outer surface;

grip protrusions that extend outwardly from the outer surfaces of the first end sidewalls; and a first lower wall connected to the lower edges of the opposing first end sidewalls and disposed below the channel, the first lower wall having an upper surface, a lower surface, and a second ridge extending upwardly from the upper surface of the first lower wall into the channel; and the second end portion comprising:

a pair of opposing second end sidewalls extending from the opposing center sidewalls of the center portion and disposed on the opposing sides of the channel, each second end sidewall having an upper edge, a lower edge, an inner surface, and an outer surface;

grip protrusions that extend outwardly from the outer surfaces of the second end sidewalls; and a second lower wall connected to the lower edges of the opposing second end sidewalls and disposed below the channel, the second lower wall having an upper surface, a lower surface, and a third ridge extending upwardly from the upper surface of the second lower wall into the channel.

12. The apparatus of claim 11 wherein the outer surfaces of the opposing center sidewalls, the outer surfaces of the first end sidewalls, and the outer surfaces of the second end sidewalls are tilted an angle that ranges from about 4 degrees to about 6 degrees with respect to the first and second lower walls.

13. The apparatus of claim 11 further comprising:

first upper fillets that connect the first ridge to the lower surface of the upper wall; and second upper fillets that connect the inner surfaces of the opposing center sidewalls to the lower surface of the upper wall, wherein the first upper fillets, the second upper fillets, the inner surfaces of the center sidewalls, and the lower surface of the upper wall define rounded surfaces that are dimensioned and configured for securely receiving the pair of parallel reinforcing bars having a round outer profile.

14. The apparatus of claim 11 further comprising:

first lower fillets that connect the second ridge to the upper surface of the first lower wall;

second lower fillets that connect the inner surfaces of the first end sidewalls to the upper surface of the first lower wall;

third lower fillets that connect the third ridge to the upper surface of the second lower wall; and fourth lower fillets that connect the inner surfaces of the second end sidewalls to the upper surface of the second lower wall, wherein the first lower fillets, the second lower fillets, the third lower fillets, the fourth lower fillets, the inner surfaces of the first and second end sidewalls, and the upper surfaces of the first and second lower walls define rounded surfaces that are dimensioned and configured for securely receiving the pair of parallel reinforcing bars having a round outer profile.

15. The apparatus of claim 11 wherein the center portion, the first end portion, and the second end portion comprise a unitary structural element.

16. The apparatus of claim 15 wherein the center portion, the first end portion, and the second end portion are formed from a continuous piece of thermoplastic material.

* * * * *